US007588414B2

(12) United States Patent
Wunderlich et al.

(10) Patent No.: US 7,588,414 B2
(45) Date of Patent: Sep. 15, 2009

(54) ARRANGEMENT FOR INTERNAL PASSIVE TURBINE BLADE TIP CLEARANCE CONTROL IN A HIGH PRESSURE TURBINE

(75) Inventors: Thomas Wunderlich, Rangsdorf (DE); Peter Broadhead, Derby (GB)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 392 days.

(21) Appl. No.: 11/403,809

(22) Filed: Apr. 14, 2006

(65) Prior Publication Data

US 2006/0233642 A1 Oct. 19, 2006

(30) Foreign Application Priority Data

Apr. 14, 2005 (EP) ..... 05090109

(51) Int. Cl.
*F01D 11/18* (2006.01)

(52) U.S. Cl. ..... 415/138; 415/191

(58) Field of Classification Search ..... 415/138, 415/173.1, 173.7, 190, 209.2, 209.3
See application file for complete search history.

(56) References Cited

U.S. PATENT DOCUMENTS 4,354,687 A 10/1982 Holland
4,384,822 A * 5/1983 Schweikl et al. ..... 415/138
6,163,959 A 12/2000 Arraitz
2005/0089400 A1 4/2005 Schiebold

FOREIGN PATENT DOCUMENTS

EP 1512842 A2 3/2005
GB 2061396 5/1981

* cited by examiner

*Primary Examiner*—Richard Edgar
(74) *Attorney, Agent, or Firm*—Timothy J. Klima; Shuttleworth & Ingersoll, PLC

(57) ABSTRACT

A passive internal control system for rotor blade tip clearance of a high-pressure turbine is based on inner rings that expand in a radial direction under the influence of heat and radially adjust the clearance delimited by liner segments (9) on the casing side. It comprises a radially expandable U-shaped downstream inner ring (10) mounted to inner platforms (7*b*) of guide vanes (7) on a side where the rotor does not have a static bearing, said ring providing expansion compensation in the axial and peripheral directions and forming a torsion box (8) with struts (13, 14) that absorbs rolling and tilting moments.

16 Claims, 3 Drawing Sheets

ARRANGEMENT FOR INTERNAL PASSIVE TURBINE BLADE TIP CLEARANCE CONTROL IN A HIGH PRESSURE TURBINE

This application claims priority to European Patent Application EP 05090109.9 filed Apr. 14, 2005, the entirety of which is incorporated by reference herein.

BACKGROUND OF THE INVENTION

The invention relates to an arrangement for internal passive turbine blade tip clearance control in a high-pressure turbine in which casing segments located above the blade tips of the rotor are supported at their front and rear ends by radially movable guide vane segments and concentric inner rings acting upon them whose thermal expansion and contraction matches the load-dependent expansion or contraction of the rotor to provide controlled radial movement of the casing segments to control the blade tip clearance.

In aircraft gas turbines, the clearance between the blade tips of the rotor of the high-pressure turbine and the non-rotating parts of the casing or liners located at a spacing opposite the blade tips must remain constant under various flight conditions and loads to keep output and fuel losses low in all phases of the flight and to ensure high turbine efficiency. The clearance must also be wide enough to prevent friction of the rotating blade tips on the static parts due to rotor expansion or contraction under transitional conditions such as take-off, landing, acceleration, or deceleration. The width of the clearance must therefore be controlled due to the varying thermal and dynamic load of the rotor in various operating states and the exclusively thermal expansion of the static elements located opposite the blade tips.

A passive automatic clearance control mechanism has been proposed in addition to expensive active clearance width control by a controlled supply of cold or hot air to keep the blade tip clearance at as constant and low a value as possible in all operating phases and to utilize the energy generated effectively without allowing contact of the rotor blade tips with the adjacent static casing parts in a phase of lower thermal and dynamic rotor load.

For example, GB 20 61 396 describes an internal passive control mechanism of the blade tip clearance in which a segmented liner is spaced from the rotor blade tips and supported upstream of the rotor on the outer platforms of the nozzle guide vanes and downstream of the rotor on the outer platforms of guide vanes of a subsequent low-pressure turbine stage. The inner platforms of the guide vane segments on both sides of the high-pressure turbine are each connected with an annular member whose thermal expansions and contractions match those of the high-pressure turbine rotor. The annular members mounted to the guide vane segments on both sides increase or decrease in this internal passive blade tip control system depending on the rotor load and the varying radial expansion or contraction of the rotor disk and blades so that the guide vane segments and the liner segments they support are adjusted in radial direction either outwardly or inwardly. This ensures passive automatic blade tip clearance control as a function of the load conditions in the high-pressure turbine.

However, this internal passive blade tip clearance control system cannot be applied to turbines in which a firm structure downstream of the rotor is missing and where there is no support of the inner ring that is attached to the radially movable guide vane segments. This applies, for example, to turbines in which the downstream rotor does not have a static bearing but sits in a rotating component of the high-pressure turbine, as there is no static rear structure to which annular member that acts on the guide vanes could be attached.

BRIEF SUMMARY OF THE INVENTION

It is an object of the invention to provide an arrangement for internal passive blade tip clearance control as mentioned above for a high-pressure turbine that does not have a rotor with a downstream static support.

This problem is solved according to the invention by the arrangement comprising the characteristics described herein. The description below discloses advantageous improvements and useful embodiments of the invention.

When using an internal passive control system of the blade tip clearance by upstream and downstream inner rings that act via guide vane segments on radially movable segments located along the inner peripheral line of the turbine casing to influence the expansion behavior of the rotor, the inventive idea for a rotor that has no static support in the low-pressure turbine but instead sits, for example, in its rotating inner raceway, is forming a torsion box that originates from the inner platforms of the guide vane segments and which is not attached to any static structure. The torsion box becomes bigger or smaller depending on the expansions and contractions of the rotor and the respective temperatures and acts on the liner segments, thereby automatically and passively controlling the blade tip clearance but having a design that ensures expansion compensation in axial and peripheral direction to relieve tension. The torsion box comprises a U-shaped downstream inner passive ring that is not attached to any static structure but the open end of which is attached to the platforms of the guide vane segments and the radial expansion of which is transmitted to the guide vane segments and thus to the segments that limit the blade tip clearance.

In addition to applying forces that act in radial direction on the casing segments, the torsion box formed by the U-shaped downstream inner passive ring and struts that stretch from the inner platforms can absorb the rolling and tilting moments that act on the guide vanes as a result of the gas forces.

The legs of the U-shaped downstream inner passive ring of the torsion box are mounted to struts that themselves form a U-shaped profile with the inner platforms of the guide vane segments using detachable fixing means so that expansion forces acting in axial and peripheral directions are compensated.

In addition, the guide vanes are held and radially guided by a plurality of radially extending fingers/slots positioned around the periphery of the casing that interleave with corresponding fingers/slots on the outer platforms. They are fixed in the axial direction using a retainer ring on the turbine casing.

The legs of the U-shaped downstream inner passive ring with the struts that are molded onto the platforms and are level with the legs are connected using a split taper socket that on one axial side can be slid into holes in the leg and presses the strut firmly against the leg from the opposite axial side with a screw bolt that is anchored in the split taper socket. While the sliding fit of the split taper socket on one axial side of the torsion box ensures expansion compensation in the axial direction, an oblong hole extending in the peripheral (circumferential) direction is provided in every other split taper socket mount for expansion compensation in the peripheral direction. Thus, each torsion box is fixed circumferentially at one side but allowed to expand or contract circumferentially on the other side by provision of the peripherally extending oblong holes.

BRIEF DESCRIPTION OF THE DRAWINGS

An embodiment of the invention is explained in greater detail below with reference to the figures. Wherein.

DETAILED DESCRIPTION OF THE INVENTION

Figure 1:
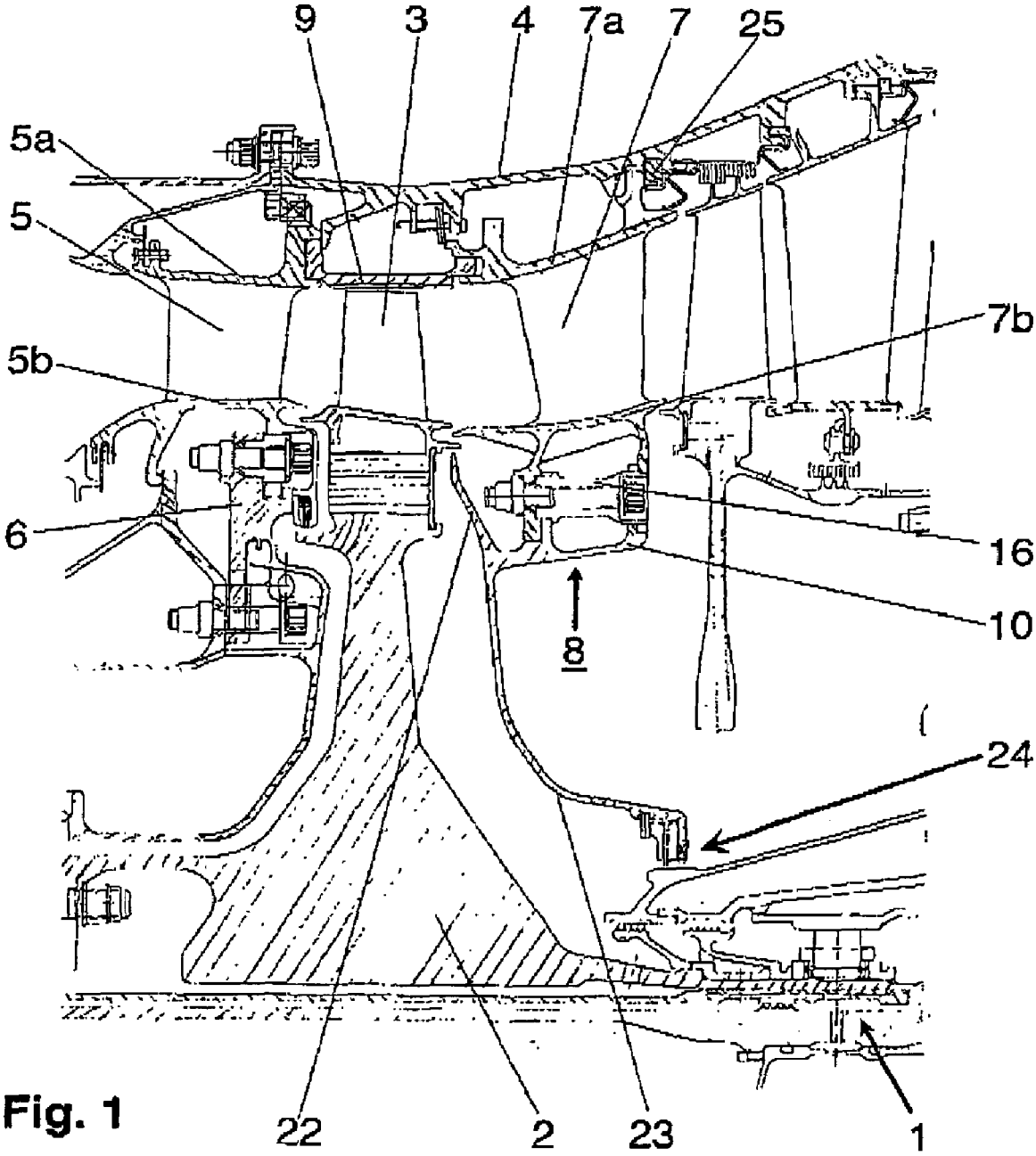
FIG. 1 shows a partial view of a high-pressure turbine section of a power unit that has upstream static and downstream non-static support.

The high-pressure turbine (HPT) of the power unit includes a rotor that is statically supported in an upstream direction and non-statically supported in a downstream direction by an inter-shaft bearing 1 of the subsequent low-pressure turbine (LPT, not shown) and includes a rotor disk 2 and rotor blades 3 mounted on its periphery.

The guide vane segments 5 of the high-pressure turbine located upstream of the rotor blades 3, the outer platforms 5*a* of which are held movable in a radial direction on the turbine casing 4 and are connected via their inner platforms 5*b* to an inner passive ring 6 mounted to a fixed structure, the thermal expansions and contractions of which match those of the rotor 2. Located downstream of the rotor blades 3, the guide vane segments 7 of the subsequent low-pressure turbine are also guided on the turbine casing 4 so that they can move in the radial direction while a torsion box 8 serving as an inner passive ring, the thermal expansions and contractions of which match those of the rotor 2, is formed on their inner platforms 7*b*. The outer platforms 5*a*, 7*a* of guide vane segments 5, 7 are connected to a liner segment 9 located above the tips of the rotor blades 3. Due to the matching expansion properties of the rotor, the torsion box 8, and the upstream inner passive ring 6, the liner segments 9 are raised or lowered in the radial direction to the same extent as the rotor disk 2 and rotor blades 3 expand or contract in the radial direction as a result of the current load conditions, ensuring a constant small clearance of the blade tips at various thermal loads to keep output and fuel losses of the turbine low.

Figure 2:
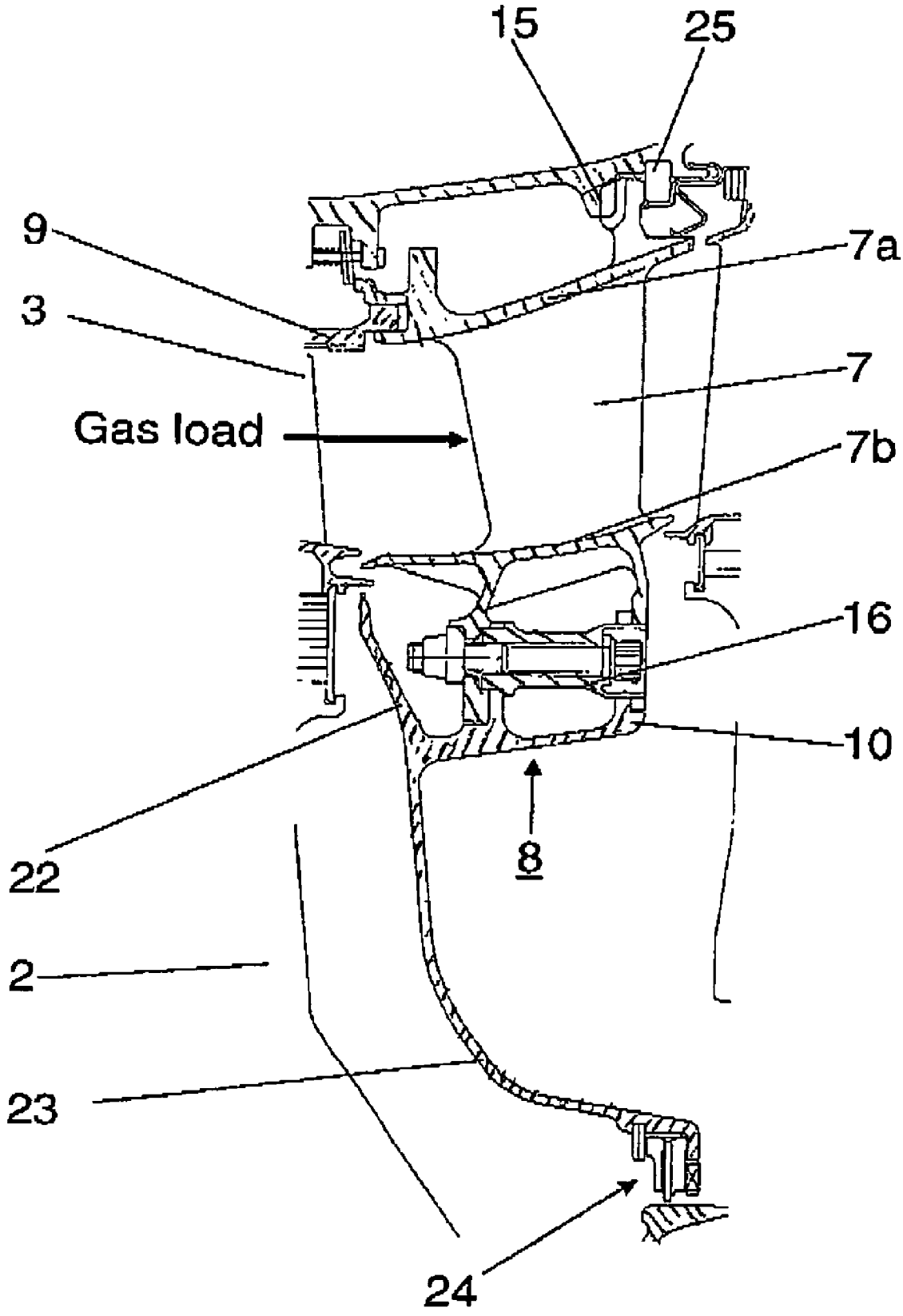
FIG. 2 shows an enlarged view of a guide vane segment fixed to the turbine casing so that it can move in the radial direction and is mounted in a downstream direction on an expansion ring designed as a torsion box.
Figure 3:
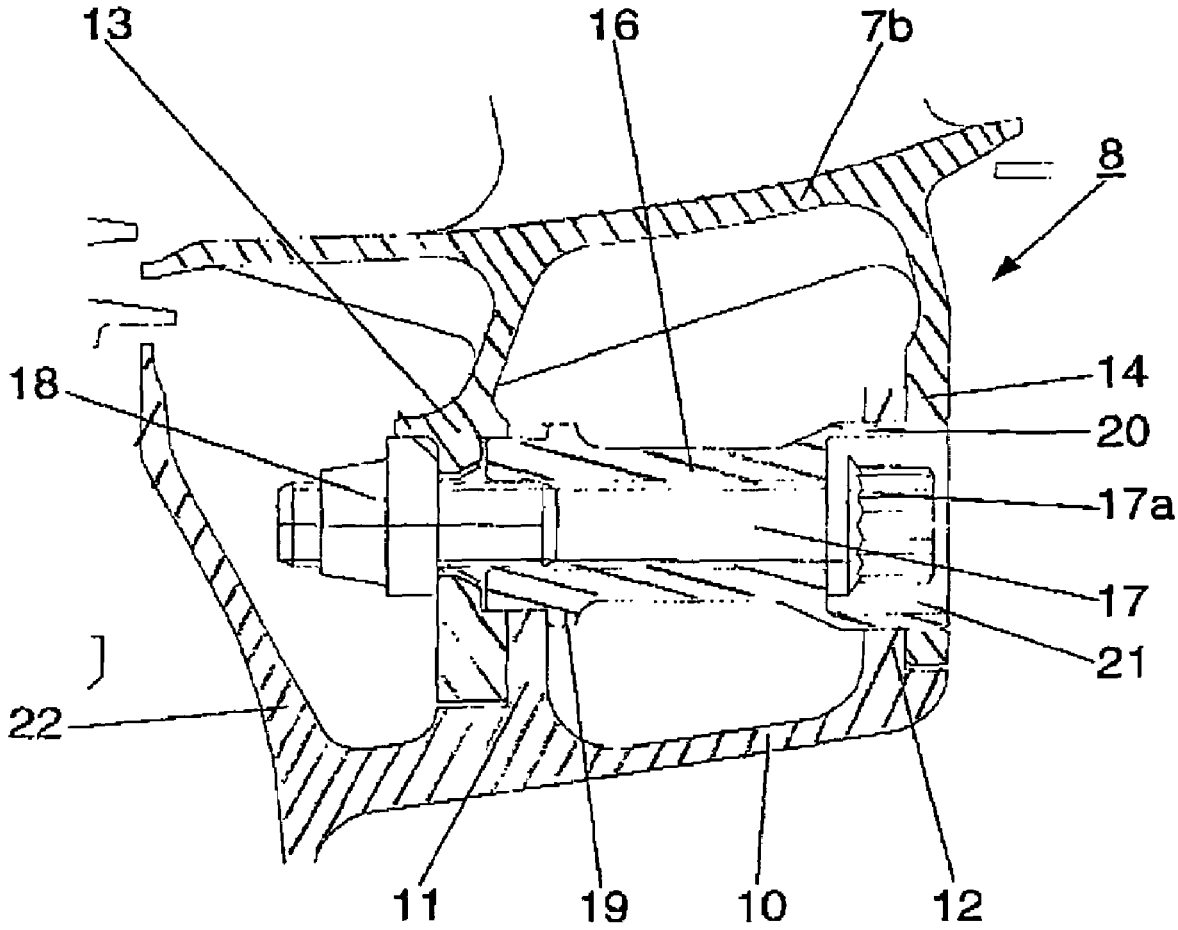
FIG. 3 shows a detailed view of the torsion box.

As there is no firm structure available in the downstream direction for mounting an expansion ring that acts on the liner segments, the latter is replaced by a U-shaped (in cross-section) downstream inner passive ring 10, the legs 11, 12 of which are connected to struts 13, 14 that stretch in a radial direction from the inner platform 7*b* of the guide vane segments 7, said struts also forming a U-shaped profile with the platform 7*b*. The firm connection of the legs 11, 12 of the U-shaped ring 10 with struts 13, 14 creates the torsion box 8 mentioned above on platform 7*b* which—without being fastened to a firm structure—is capable of absorbing the forces that act on the guide vanes 7. In addition, the guide vane segments 7 are held by their outer platforms 7*a* on the turbine casing 4 in the peripheral direction and guided in the radial direction by an interleaved connection with a plurality of alternating fingers/slots 15 positioned around a periphery of turbine casing 4(FIG. 2) and are fixed in the axial direction by a retainer ring 25.

The front and rear struts 13, 14 of inner platforms 7*b* of guide vanes 7 are connected to the U-shaped downstream inner passive ring 10 using specially designed split taper sockets 16 and screw bolts 17 with rivet nut 18. Struts 13, 14 reach over the legs 11, 12 of the U-shaped downstream inner passive ring 10. The legs or struts comprise regular round holes that are flush with each other and, viewed in the peripheral direction of the torsion box, oblong holes that are flush with each other. In a preferred embodiment, each platform 7*b* includes a pair of circumferentially spaced split taper sockets. Round holes and circumferentially extending oblong holes alternate in the peripheral direction, that is, each strut 13, 14 of each platform includes a round hole and an oblong hole.

The split taper socket 16 comprises a collar 19 that is at a spacing from its front end and adjacent to the inner surface of the front leg 11 of U-shaped downstream inner passive ring 10. The rear section of the split taper socket 16 comprises an even, smooth area 20 that is fitted into the flush holes of the rear leg 12 and the rear strut 14 and allows a sliding movement. A frontal relief 21 in the split taper socket 16 receives the bolt head 17*a* of screw bolt 17. The U-shaped downstream inner passive ring 10 that enables passive blade tip clearance control downstream is tightened to struts 13, 14 of inner platform 7*b* on one side using the split taper socket 16 of the design described above and the screw bolt 17 with self-locking nut 18 and attached slidingly to the opposite side to compensate thermal expansion in the axial direction. Thermal expansion in the circumferential direction of the torsion box 8 is compensated for by the partial fastening in circumferentially extending oblong holes. It is particularly apparent from FIG. 2 that a circulatory sealing dam 22 for protecting the rivet nuts 18 and a protective shield 23 that stretches to the inter-shaft bearing 1 and comprises an edge and brush packing 24 are molded onto the U-shaped downstream inner passive ring 10 of torsion box 8. Shielding the rivet nuts 18 and the screw bolt heads, as well as providing the protective shield 23, minimizes ventilation losses.

List of Reference Symbols

1 Inter-shaft bearing
2 Rotor disk
3 Rotor blades
4 Turbine casing
5 Guide vane segment (HPT)
5*a* Outer platform
5*b* Inner platform
6 Upstream inner passive ring
7 Guide vane segment (LPT)
7*a* Outer platform
7*b* Inner platform
8 Torsion box
9 Liner segment
10 Downstream inner passive ring
11, 12 Legs of 10
13, 14 Struts of 7*b*
15 Interleaved connection
16 Split taper socket
17 Screw bolt
17*a* Screw head
18 Rivet nut
19 Collar
20 Even area, sliding area of 16
21 Relief of 16
22 Sealing dam
23 Protective shield
24 Edge and brush packing
25 Retainer ring

The invention claimed is:

1. An arrangement for internal passive turbine blade tip clearance control in a high-pressure turbine in which casing segments located above blade tips of a turbine rotor are supported at front and rear ends of outer platforms thereof by radially movable guide vane segments and concentric inner rings acting upon them whose thermal expansion and contraction behavior matches a load-dependent expansion/contraction of the rotor to provide controlled radial movement of the casing segments to control the blade tip clearance, wherein, an inner platform of each guide vane segment includes front and rear struts forming a U-shaped profile and which are mounted to a U-shaped downstream inner passive ring to form a torsion box which compensates for thermal expansions/contractions in both axial and circumferential directions; the downstream inner passive ring including a first leg and a second leg forming the U-shape, the first leg being firmly tightened to one of the first and second struts of the inner platform with a split taper socket and a threaded fastener, the split taper socket having a collar at one end and a smooth area at an opposite end which is slidingly fitted into holes of the second leg and the other of the first and second struts for expansion/contraction compensation in the axial direction.

2. The arrangement according to claim 1, wherein, the threaded fastener is a bolt and a safety nut, and every alternating hole that receives a bolt in the legs/struts is a circumferentially extending oblong hole to provide expansion compensation in the circumferential direction.

3. The arrangement according to claim 2, wherein the split taper socket comprises a relief on one end that receives a head of the bolt to minimize ventilation losses.

4. The arrangement according to claim 3, wherein the torsion box comprises an upstream circulatory sealing dam extending towards the inner platform to shield a portion of the bolt and nut that protrudes from an outer surface of the torsion box to minimize ventilation losses.

5. The arrangement according to claim 3, wherein the torsion box comprises a circulatory protective shield extending inwards and includes at least one of an edge packing and a brush packing on a free edge thereof to minimize ventilation losses.

6. The arrangement according to claim 5, wherein guide vane segments equipped with the torsion box are held in a peripheral direction and guided in the radial direction by an interleaved connection between a turbine casing and the outer platforms and a retainer ring is provided for axial fixation of the guide vane segments.

7. The arrangement according to claim 6, wherein the casing segments located upstream of the rotor blade tips are liner segments that can be moved in the radial direction.

8. The arrangement according to claim 7, wherein a downstream bearing of the rotor is a non-static inter-shaft bearing of a subsequent low-pressure turbine.

9. The arrangement according to claim 1, wherein the torsion box comprises an upstream circulatory sealing dam extending towards the inner platform to shield a portion of the threaded fastener that protrudes from an outer surface of the torsion box to minimize ventilation losses.

10. The arrangement according to claim 1, wherein the torsion box comprises a circulatory protective shield extending inwards and includes at least one of an edge packing and a brush packing on a free edge thereof to minimize ventilation losses.

11. The arrangement according to claim 1, wherein guide vane segments equipped with the torsion box are held in a peripheral direction and guided in the radial direction by an interleaved connection between a turbine casing and the outer platforms and a retainer ring is provided for axial fixation of the guide vane segments.

12. The arrangement according to claim 1, wherein the casing segments located upstream of the rotor blade tips are liner segments that can be moved in the radial direction.

13. The arrangement according to claim 1, wherein a downstream bearing of the rotor is a non-static inter-shaft bearing of a subsequent low-pressure turbine.

14. An arrangement for internal passive turbine blade tip clearance control in a high-pressure turbine in which casing segments located above blade tips of a turbine rotor are supported at front and rear ends of outer platforms thereof by radially movable guide vane segments and concentric inner rings acting upon them whose thermal expansion and contraction behavior matches a load-dependent expansion/contraction of the rotor to provide controlled radial movement of the casing segments to control the blade tip clearance, wherein, an inner platform of each guide vane segment includes front and rear struts forming a U-shaped profile and which are mounted to a U-shaped downstream inner passive ring to form a torsion box which compensates for thermal expansions/contractions in both axial and circumferential directions; wherein the torsion box comprises an upstream circulatory sealing dam extending towards the inner platform to shield a portion of a threaded fastener that protrudes from an outer surface of the torsion box to minimize ventilation losses.

15. The arrangement according to claim 14, wherein the threaded fastener is a bolt and a safety nut, the downstream inner passive ring includes a first leg and a second leg forming the U-shape, the first leg being firmly tightened to one of the tint and second struts of the inner platform with a split taper socket, the bolt and the safety nut, the split taper socket having a collar at one end and a smooth area at an opposite end which is slidingly fitted into holes of the second leg and the other of the first and second struts for expansion/contraction compensation in an axial direction, and with every alternating hole that receives a bolt in the legs/struts is circumferentially extending oblong hole to provide expansion compensation in the circumferential direction.

16. The arrangement according to claim 15, wherein the split taper socket comprises a relief on one end that receives a head of the bolt to minimize ventilation losses.

* * * * *